US008562316B2

(12) United States Patent
Yamamuro et al.

(10) Patent No.: US 8,562,316 B2
(45) Date of Patent: Oct. 22, 2013

(54) VARIABLE CAPACITY VANE PUMP

(75) Inventors: Shigeaki Yamamuro, Zushi (JP); Hideo Konishi, Osato-gun (JP); Fusao Semba, Hiki-gun (JP)

(73) Assignee: Hitachi, Ltd., Tokyo (JP)

( * ) Notice: Subject to any disclaimer, the term of this patent is extended or adjusted under 35 U.S.C. 154(b) by 738 days.

(21) Appl. No.: 12/678,048

(22) PCT Filed: Sep. 20, 2007

(86) PCT No.: PCT/JP2007/068238
§ 371 (c)(1),
(2), (4) Date: Mar. 12, 2010

(87) PCT Pub. No.: WO2009/037764
PCT Pub. Date: Mar. 26, 2009

(65) Prior Publication Data
US 2011/0268595 A1 Nov. 3, 2011

(51) Int. Cl.
*F04C 14/18* (2006.01)
*F04C 14/22* (2006.01)
*F01C 20/18* (2006.01)
*F01C 20/22* (2006.01)

(52) U.S. Cl.
USPC ..... 418/29; 418/30; 418/31

(58) Field of Classification Search
USPC ..... 418/22–27, 29–31
See application file for complete search history.

(56) References Cited

U.S. PATENT DOCUMENTS 5,895,209 A * 4/1999 Miyazawa ..... 418/26
6,382,925 B1 * 5/2002 Oba et al. ..... 418/16
6,976,830 B2 * 12/2005 Uchino ..... 418/30
7,674,095 B2 * 3/2010 Hunter et al. ..... 418/26
8,282,369 B2 * 10/2012 Yamamuro et al. ..... 418/30
2002/0064471 A1 5/2002 Kojima et al.

(Continued)

FOREIGN PATENT DOCUMENTS

JP 2002-115673 A 4/2002
JP 2003-74479 A 3/2003

(Continued)

OTHER PUBLICATIONS

International Search Report with English translation dated Oct. 16, 2007 (Five (5) pages).
PCT/ISA/237 dated Oct. 16, 2007 (Three (3) pages).

*Primary Examiner* — Mary A Davis
(74) *Attorney, Agent, or Firm* — Crowell & Moring LLP

(57) ABSTRACT

In a variable capacity vane pump, a space between adjacent vanes is 1 pitch. A line that connects a half-pitch-advanced position from an end edge of an inlet port or from an end edge of an outlet port and a driving shaft center in a no-load state is termed a port reference line. A line that connects a center of a cam ring inner circumference side and the driving shaft center when an eccentricity amount of a cam ring is a maximum is termed a high pressure cam profile reference line. A line that connects the center of the cam ring inner circumference side and the driving shaft center at a low pressure when the eccentricity amount of the cam ring is a minimum is termed a low pressure cam profile reference line. The three reference lines; the port reference line, the high pressure cam profile reference line and the low pressure cam profile reference line, is set to be substantially parallel to each other.

12 Claims, 8 Drawing Sheets

(56) References Cited

U.S. PATENT DOCUMENTS

| | | | | |
|---|---|---|---|---|
| 2005/0019174 | A1 | 1/2005 | Uchino et al. | |
| 2007/0148029 | A1 | 6/2007 | Yamamuro et al. | |
| 2010/0303660 | A1 * | 12/2010 | Konishi et al. | 418/31 |

FOREIGN PATENT DOCUMENTS

| | | | |
|---|---|---|---|
| JP | 2005-42675 | A | 2/2005 |
| JP | 2007-9695 | A | 1/2007 |
| JP | 2007-170321 | A | 7/2007 |

* cited by examiner

PRESENT INVENTION

VARIABLE CAPACITY VANE PUMP

Cross reference is made to co-pending U.S. patent application Ser. No. 12/678,056, published as U.S. Patent Application Publication US 2010-0303660 A1 on Dec. 2, 2010.

TECHNICAL FIELD

The present invention relates to a variable capacity pump, and more particularly to a variable capacity vane pump for power steering.

BACKGROUND ART

A conventional variable capacity vane pump which is disclosed in a Patent Document 1 controls a pump discharge amount by rocking a cam ring.

Patent Document 1: Japanese Patent Application Kokai Publication No. 2005-42675

SUMMARY OF THE INVENTION

However, in the above conventional art technique, unlike a fixed capacity type pump, since this pump has an inlet port and an outlet port, pressure is in an unbalanced state in which a pressure of an outlet port side is greater.

This outlet port side pressure acts on a rotor and a driving shaft, and bends and shifts the driving shaft to an inlet port side, then the driving shaft is offset. This causes a deviation of switch between suction and discharge. In the conventional art technique, since both of a center of the cam ring and a center of the driving shaft in a no-load state are set on a change line (a port reference line) on which the suction and the discharge are switched, a delay of a start timing of compression occurs due to the shift of the driving shaft, and there is a problem that causes a decrease in pump efficiency and causes oscillation.

The present invention focuses attention on this problem, and an object of the present invention is to provide a variable capacity vane pump that is capable of reducing the decrease in pump efficiency and the oscillation.

In order to achieve the above object, in the present invention, a variable capacity vane pump comprises: a pump body; a driving shaft rotatably supported by the pump body; a rotor provided in the pump body and rotatably driven by the driving shaft; a plurality of vanes radially extendably installed in their respective slots that are arranged in a circumferential direction in the rotor; a cam ring rockably provided on a supporting surface with a rock fulcrum being a center in the pump body and formed into a ring shape also forming a plurality of pump chambers at an inner circumference side of the cam ring in cooperation with the rotor and the vanes; first and second members provided at both sides in an axial direction of the cam ring; an inlet port provided at least one of the first and second members and opening to a section of the pump chamber where a volume of the pump chamber increases; an outlet port provided at least one of the first and second members and opening to a section of the pump chamber where the volume of the pump chamber decreases; and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring, and a space between adjacent vanes of the plurality of vanes is 1 pitch, a line that connects a half-pitch-advanced position from an end edge of the inlet port or from an end edge of the outlet port and a center of the driving shaft in a no-load state is termed a port reference line, a line that connects a center of the cam ring inner circumference side and the center of the driving shaft at a high pressure when an eccentricity amount of the cam ring is a maximum is termed a high pressure cam profile reference line, a line that connects the center of the cam ring inner circumference side and the center of the driving shaft at a low pressure when the eccentricity amount of the cam ring is a minimum is termed a low pressure cam profile reference line, and the three reference lines; the port reference line, the high pressure cam profile reference line and the low pressure cam profile reference line, are set to be substantially parallel to each other.

DETAILED DESCRIPTION

According to the present invention, it is possible to provide the variable capacity vane pump that reduces the decrease in pump efficiency and the oscillation which are caused by the offset-shift of the driving shaft.

In the following, the variable capacity vane pump of the present invention will be explained on the basis of embodiments shown in drawings.

Embodiment 1

[Structure of Vane Pump]

Figure 1:
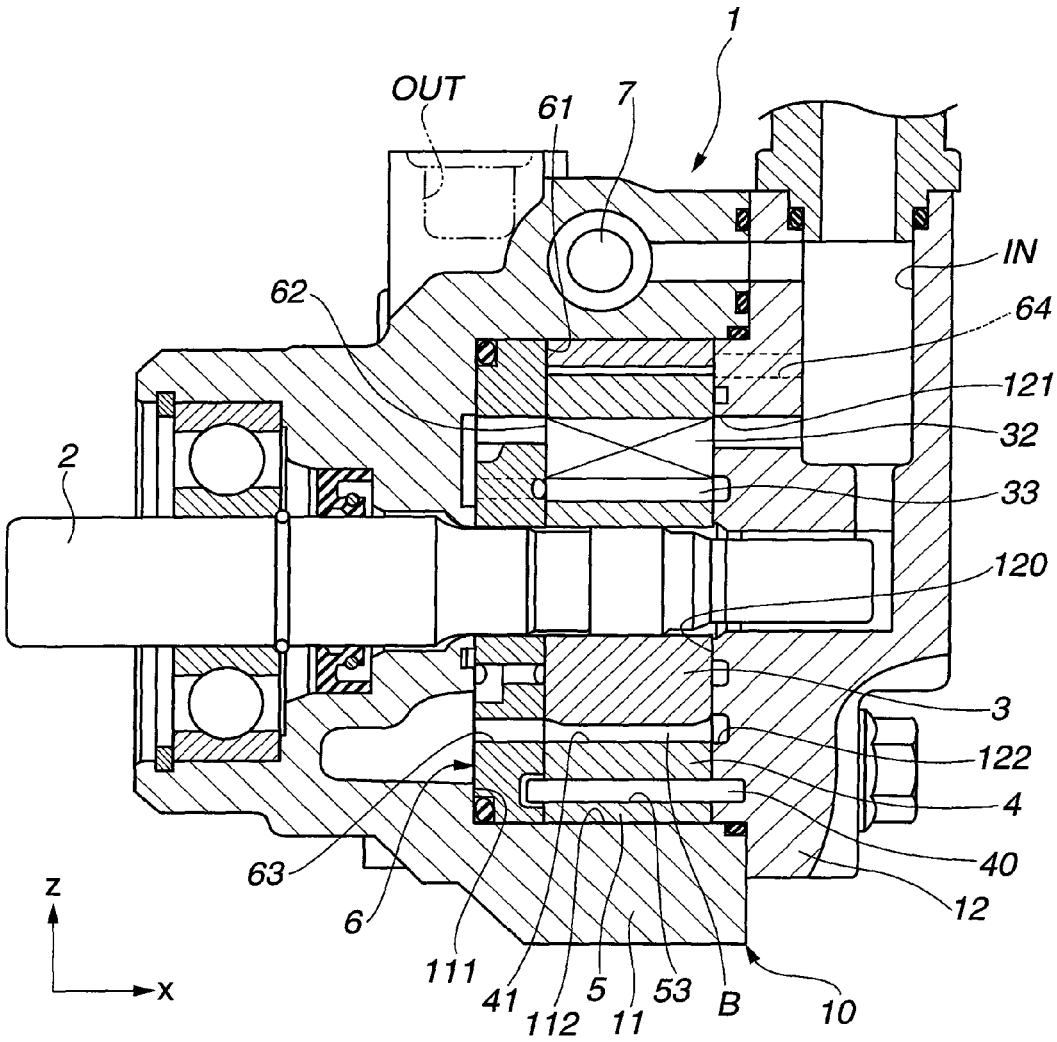
FIG. 1 is a sectional view in an axial direction of a vane pump according to an embodiment 1.
Figure 2:
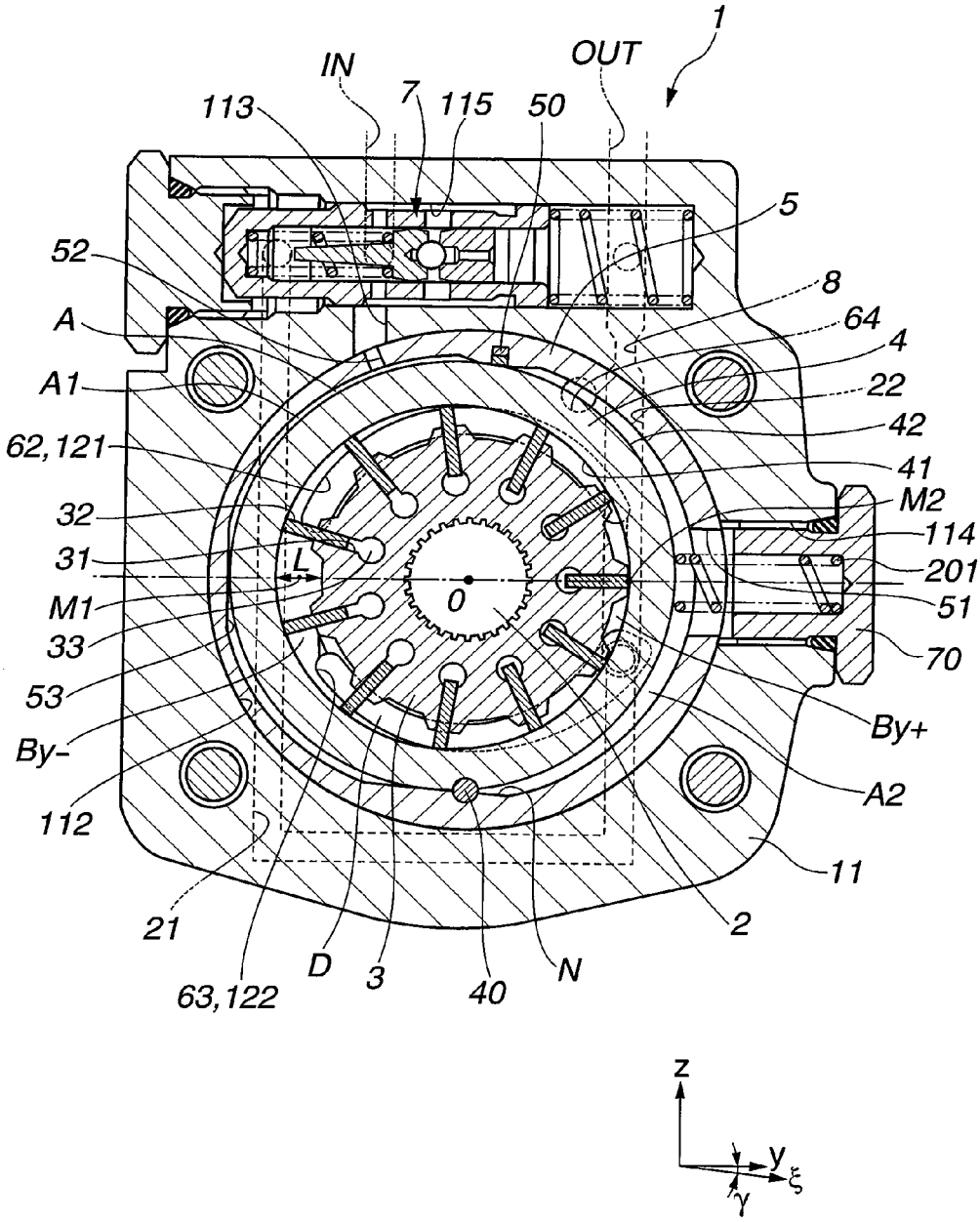
FIG. 2 is a sectional view in a radial direction of the vane pump according to the embodiment 1 (an eccentricity amount of a cam ring is a maximum).
Figure 3:
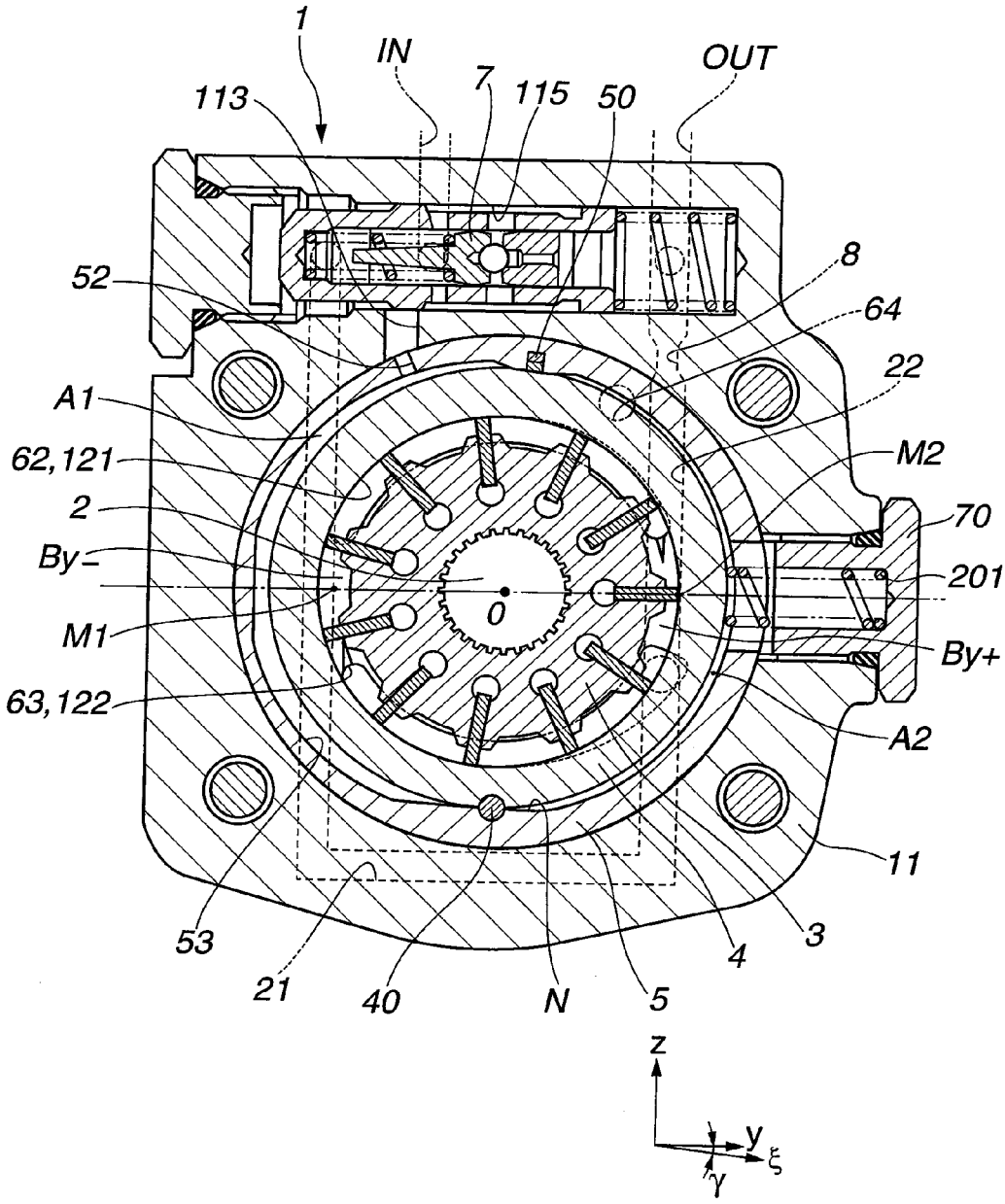
FIG. 3 is a sectional view in a radial direction of the vane pump according to the embodiment 1 (the eccentricity amount of the cam ring is a minimum).

An embodiment 1 will be explained on the basis of FIGS. 1 to 7. FIG. 1 is a sectional view in an axial direction of a vane pump 1. FIGS. 2 and 3 are sectional views in a radial direction of the vane pump 1. FIG. 2 shows a case where a cam ring 4 is positioned at an end in the negative direction of a y-axis (an eccentricity amount of the cam ring 4 is a maximum). FIG. 3 shows a case where the cam ring 4 is positioned at an end in the positive direction of the y-axis (the eccentricity amount of the cam ring 4 is a minimum).

Here, in the drawings, an axial direction of a driving shaft 2 is defined as an x-axis, and a direction in which the driving shaft 2 is inserted into first and second housings 11, 12 is positive direction of the x-axis. Further, an axial direction of a spring 201 that restrains a rock of the cam ring 4 is defined as the y-axis (see FIG. 2), and a direction in which the spring 201 forces the cam ring 4 is the negative direction of the y-axis. An axis orthogonal to the x-axis and the y-axis is a z-axis, and a direction where an inlet vent "IN" is located is positive direction of the z-axis.

The vane pump 1 has the driving shaft 2, a rotor 3, the cam ring 4, an adapter ring 5, and a pump body 10. The driving shaft 2 is connected to an engine through a pulley, and rotates integrally with the rotor 3.

A plurality of slots 31 are radially formed at the rotor 3 and arranged around a periphery of the rotor 3. This slot 31 is a groove formed in axial direction, and a vane 32 is provided in each slot 31. The vane 32 is inserted into the slot 31 so that the vane 32 can move or extend in radial direction. In an inner radial side end portion of each slot 31, a back-pressure chamber 33, in which a pressurized fluid is provided, is formed for forcing the vane 32 outwards in the radial direction by the pressurized fluid.

The pump body 10 is formed of a first housing 11 and a second housing 12 (a second member). The first housing 11 is formed into a cup-shape having a bottom, which opens to the positive direction of the x-axis. At a bottom portion 111 of the first housing 11, a disk shaped side plate 6 (a first member) is installed. The adapter ring 5, the cam ring 4 and the rotor 3 are accommodated in a pump element accommodation portion 112 that is an inner circumferential portion of the first housing 11, at the positive direction side of x-axis of the side plate 6.

The second housing 12 is in liquid-tight contact with the adapter ring 5, the cam ring 4 and the rotor 3 from the positive direction side of the x-axis. The adapter ring 5, the cam ring 4 and the rotor 3 are sandwiched between the side plate 6 and the second housing 12, and are held by these side plate 6 and second housing 12.

On an x-axis positive direction side surface 61 of the side plate 6 and on an x-axis negative direction side surface 120 of the second housing 12, inlet ports 62, 121 and also outlet ports 63, 122 are respectively provided. These inlet and outlet ports communicate with the inlet vent "IN" and an outlet vent "OUT" respectively, then supply and exhaust of working fluid for a pump chamber "B" that is formed between the rotor 3 and the cam ring 4 are done.

The adapter ring 5 is an oval-shaped ring member that is formed into a substantially oval whose y-axis is major (longer) axis and whose z-axis is minor axis. The adapter ring 5 is installed inside the first housing 11, and the cam ring 4 is installed inside the adapter ring 5. In order for the adapter ring 5 not to rotate in the first housing 11 during the pump drive, the rotation of the adapter ring 5 with respect to the first housing 11 is restrained by a pin 40.

The cam ring 4 is a ring shaped member that is formed into a substantially perfect circle, and its diameter is substantially equal to a diameter of an inner circumference of the minor axis of the adapter ring 5. Therefore, since the cam ring 4 is installed inside the oval-shaped adapter ring 5, a hydraulic pressure chamber "A" is defined between the inner circumference of the adapter ring 5 and an outer circumference of the cam ring 4 in a space outside the outer circumference of the cam ring 4. The cam ring 4 can therefore rock or tilt inside the adapter ring 5 in the y-axis direction.

A seal member 50 (a first seal member) is provided at a top end portion in the positive direction of the z-axis on an adapter ring inner circumferential surface 53. On the other hand, at a bottom end portion in negative direction of the z-axis on the inner circumferential surface 53, a supporting surface "N" is formed. The adapter ring 5 supports the cam ring 4 and stops a movement in the negative direction of the z-axis of the cam ring 4 by the supporting surface "N".

On the supporting surface "N", the pin 40 (a second seal member) is provided. The above mentioned hydraulic pressure chamber "A" between the cam ring 4 and the adapter ring 5 is divided into two hydraulic pressure chambers by this pin 40 and the seal member 50 at the negative and positive direction sides of the y-axis respectively, and a first hydraulic pressure chamber A1 and a second hydraulic pressure chamber A2 are defined.

Here, since the cam ring 4 rocks or tilts while rotating on the supporting surface "N", each capacity or volume of the first and second hydraulic pressure chambers A1, A2 is varied. However, the supporting surface "N" at the negative direction side of the z-axis is formed to be parallel to $\xi$-axis that is defined by rotating the y-axis in a clockwise direction with an origin point being a center. That is, the supporting surface "N" slants or slopes at an angle $\gamma$ in the negative direction of the z-axis as the supporting surface "N" extends in the positive direction of the y-axis. And then, this sloping supporting surface "N" allows the cam ring 4 easily to rock or tilt in the positive direction of the y-axis.

An outside diameter of the rotor 3 is smaller than that of a cam ring inner circumference 41 of the cam ring 4, and the rotor 3 is installed inside the cam ring 4. The rotor 3 is provided so that an outer circumference of the rotor 3 does not touch the cam ring inner circumference 41 even when the cam ring 4 rocks and a relative position between the rotor 3 and the cam ring 4 changes.

In a case where the cam ring 4 rocks and is positioned at the end in the negative direction of the y-axis inside the adapter ring 5, a distance "L" between the cam ring inner circumference 41 and the outer circumference of the rotor 3 becomes a maximum. On the other hand, in a case where the cam ring 4 is positioned at the end in the positive direction of the y-axis inside the adapter ring 5, the distance "L" becomes a minimum.

A length in the radial direction of the vane 32 is set to be longer than the maximum distance "L". Therefore, the vane 32 always touches the cam ring inner circumference 41 while being inserted in the slot 31 irrespective of the relative position between the rotor 3 and the cam ring 4. By this setting, the vane 32 always receives a back pressure from the back-pressure chamber 33, and the vane 32 liquid-tightly touches the cam ring inner circumference 41.

Accordingly, liquid-tight spaces between the cam ring 4 and the rotor 3 are always defined by the plurality of the adjacent vanes 32, and the pump chamber "B" is formed. Under a state where a center of the cam ring 4 shifts from a center of the rotor 3 by the rock of the cam ring 4 (i.e. the rotor 3 and the cam ring 4 are under an eccentric position), volume of each pump chamber "B" varies by the rotation of the rotor 3.

The inlet ports 62, 121 and the outlet ports 63, 122, respectively provided in the side plate 6 and the second housing 12, are formed along the outer circumference of the rotor 3, and the supply and exhaust of the working fluid are done by the volume change of the each pump chamber "B".

At an end portion in the positive direction of the y-axis of the adapter ring 5, a radial-direction penetration hole 51 is formed. Further, a plug member insertion hole 114 is formed at an end portion in the positive direction of the y-axis of the first housing 11. Then, a plug member 70 formed into a cup-shape having a bottom is inserted into the plug member insertion hole 114, and an inside of the pump is insulated from an outside of the first and second housings 11, 12 and the liquid-tight inside of the pump is maintained.

The previously mentioned spring 201 is inserted into the plug member 70, and is secured in an inner circumference of the plug member 70 so that the spring 201 is extendable and contractible in the y-axis direction. More specifically, the spring 201 penetrates the radial-direction penetration hole 51 of the adapter ring 5 and touches or contacts the cam ring 4, then forces the cam ring 4 in the negative direction of the y-axis.

The spring 201 is a spring that forces the cam ring 4 in the negative direction of the y-axis, in which an amount of the rock of the cam ring 4 becomes a maximum. Further, the spring 201 is the one that stabilizes the discharge amount (a rocking position of the cam ring 4) during a pump startup in which the pressure is not steady.

In the embodiment, an opening of the radial-direction penetration hole 51 of the adapter ring 5 acts as a stopper that limits the rock in the positive direction of the y-axis of the cam ring 4. However, the plug member 70 itself could penetrate the radial-direction penetration hole 51 and protrude from the inner circumference of the adapter ring 5, and then act as the stopper for limiting the rock in the positive direction of the y-axis of the cam ring 4.

[Supply of the Pressurized Fluid to First and Second Hydraulic Pressure Chambers]

A through hole 52 is provided at upper portion in the positive direction of the z-axis of the adapter ring 5, at aside of the seal member 50 in the negative direction of the y-axis. This through hole 52 communicates with a control valve 7 via an oil passage 113 that is provided inside the first housing 11. In addition, the through hole 52 communicates with the first hydraulic pressure chamber A1 formed at the negative direction side of the y-axis, then connects the first hydraulic pressure chamber A1 and the control valve 7. The oil passage 113 opens to a valve installation hole 115 that installs the control valve 7 therein, and a control pressure "Pv" is introduced into the first hydraulic pressure chamber A1 with the pumping action.

The through hole 52 provided at the adapter ring 5 is formed at a middle portion of adapter ring's width in the axis direction, so that an outer circumferential surface of the adapter ring 5 acts as a seal surface and leakage can be reduced.

The control valve 7 connects to the outlet ports 63, 122 through oil passages 21 and 22. An orifice 8 is provided on the oil passage 22, and an outlet pressure "Pout" that is an upstream pressure of the orifice 8 and a downstream pressure "Pfb" of the orifice 8 are introduced into the control valve 7. Then, the control valve 7 is driven by a pressure difference between these "Pout" and "Pfb" and a valve spring 7*a*, and the control pressure "Pv" is produced.

Thus, since the control pressure "Pv" is introduced into the first hydraulic pressure chamber A1 and this control pressure "Pv" is produced on the basis of an inlet pressure "Pin" and the outlet pressure "Pout", a relationship between the control pressure "Pv" and the inlet pressure "Pin" is; control pressure "Pv" ≥ inlet pressure "Pin".

On the other hand, the inlet pressure "Pin" is introduced into the second hydraulic pressure chamber A2 through a communication path 64. This communication path 64 is an oil path which communicates with the inlet vent "IN" and with the x-axis negative direction side surface 120 in the second housing 12 then connects the inlet vent "IN" and the second hydraulic pressure chamber A2. The communication path 64 always opens to the second hydraulic pressure chamber A2 irrespective of the rocking position of the cam ring 4.

Therefore, the second hydraulic pressure chamber A2 is supplied with the inlet pressure "Pin" all the time. With this, in the vane pump 1 of the present invention, only a fluid pressure P1 of the first hydraulic pressure chamber A1 is controlled. On the other hand, a fluid pressure P2 of the second hydraulic pressure chamber A2 is not controlled, and the fluid pressure P2 is equal to the inlet pressure "Pin" (P2=inlet pressure "Pin") all the time. With this, pressure leakage from the second hydraulic pressure chamber A2 side to the inlet port 62, 121 side is reduced, and the decrease in the pump efficiency is suppressed.

[Rocking of Cam Ring]

When a total force of a biasing force in the positive direction of the y-axis which the cam ring 4 receives from the pressure P1 of the first hydraulic pressure chamber A1 and a force in the positive direction of the y-axis by the rock of the cam ring 4 in the positive direction of the y-axis by gravity becomes greater than a total force of a biasing force in the negative direction of the y-axis which the cam ring 4 receives from the pressure P2 of the second hydraulic pressure chamber A2 and the spring 201 and a biasing force in the negative direction of the y-axis on a fulcrum on the supporting surface "N" by a resultant force that acts on the cam ring inner circumference 41 by a pump internal pressure, the cam ring 4 rocks in the positive direction of the y-axis with a rolling-fulcrum (that is present on the supporting surface "N") being a rotation center.

By the rocking of the cam ring 4, the eccentricity amount of the cam ring 4 becomes small, and an oil amount which is supplied from the inlet ports 62, 121 to the outlet ports 63, 122 in a unit time decreases, then the discharge amount is reduced.

As a result, a flow amount difference force of the orifice 8 decreases. The control valve 7 is then returned by the valve spring 7*a*, and the control pressure "Pv" is reduced by communication of the inlet pressure "Pin", the pressure P1 of the first hydraulic pressure chamber A1 communicating with the control valve 7 via the oil passage is consequently reduced too.

When both the force in the negative direction of the y-axis and the force in the positive direction of the y-axis, which act on the cam ring 4, substantially become equal to each other, the both forces in the y-axis direction, acting on the cam ring 4, balance out, then the cam ring 4 rests. The rock of the cam ring 4 is therefore stops, and a certain discharge flow amount is discharged.

Further, when the rotation increases, the pump discharge amount increases and the pressure difference of the orifice 8 is increased. The control valve 7 then presses the valve spring 7*a* and increases the control pressure "Pv", and the pressure P1 of the first hydraulic pressure chamber A1 is increased.

With this, by the rock and eccentricity of the cam ring 4 in the y-axis direction, the discharge flow amount is regulated to such flow amount that the pressure difference of the orifice 8 and a certain force F of the valve spring 7*a* balance out. In this way, the eccentricity amount of the cam ring 4 is adjusted so that the pressure difference between the upstream and downstream of the discharge orifice 8 is constant, and the discharge flow amount of the pump P is controlled to be constant.

[Deviation of Positions Between Driving Shaft Center and Cam Ring Center]

Figure 4:
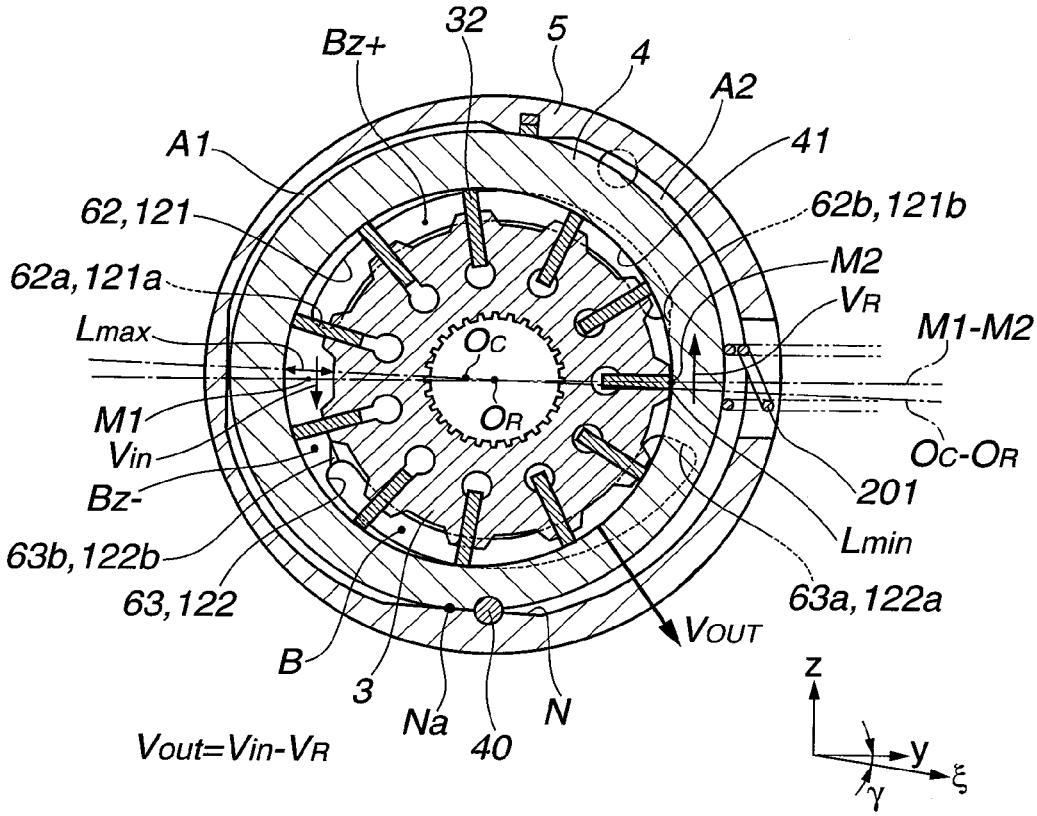
FIG. 4 is a sectional view of a part of the vane pump in a no-load state (in a no-pump-drive state).

FIG. 4 is a sectional view of a part of the vane pump 1 in a no-load state (in a no-pump-drive state). A center of the driving shaft 2 and the rotor 3 is defined as $O_R$, a center of the cam ring 4 is defined as $O_C$.

In the present embodiment, the cam ring center $O_C$ in the no-load state is set so that the cam ring center $O_C$ is positioned at the inlet port 62, 121 side (the positive direction side of the z-axis) as compared with the center $O_R$ of the driving shaft 2. The rotor 3 is forced from the negative direction side of the z-axis by the outlet pressure "Pout", and the driving shaft 2 is bent and shifted in the positive direction of the z-axis by this biasing force.

Thus, since the center $O_R$ of the driving shaft 2 shifts in the positive direction of the z-axis, the center $O_C$ of the cam ring 4 is previously offset to the positive direction side of the z-axis as compared with the driving shaft center $O_R$. More specifically, by slanting the supporting surface "N", a position in the z-axis direction of the cam ring 4 is set to be high. With this setting, even when the driving shaft 2 is bent and shifted by the outlet pressure "Pout" during the pump drive, a stable discharge amount can be ensured (details will be explained later).

[Cam Profile Reference Line]

The cam ring inner circumference 41 and the outer circumference of the rotor 3 are substantially circular. Therefore when the cam ring center $O_C$ and the driving shaft center $O_R$ are identical with each other, the distance "L" between the cam ring inner circumference 41 and the outer circumference of the rotor 3 is uniformly equal throughout their circumferences.

When the center $O_C$ of the cam ring 4 shifts from the center $O_R$ of the rotor 3 and the driving shaft 2, the distance "L" between the cam ring inner circumference 41 and the outer circumference of the rotor 3 is not uniformly equal, and the distance "L" takes a maximum vale and a minimum value on an $O_C$-$O_R$ straight line. This $O_C$-$O_R$ straight line is defined as a cam profile reference line $O_C$-$O_R$.

The vane 32 is forced outwards in the radial direction by the pressure from the back-pressure chamber 33, therefore when the distance "L" varies, a protrusion amount of the vane 32 also varies. Because of this, the volume of the pump chamber "B" defined by the outer circumference of the rotor 3 and the cam ring inner circumference 41 and the vane 32 also varies depending on the distance "L".

That is to say, in a case of a position of the cam ring 4 where the distance "L" between the cam ring inner circumference 41 and the outer circumference of the rotor 3 is large, the volume of the pump chamber "B" is also large. In a case of the position of the cam ring 4 where the distance "L" is small, the volume of the pump chamber "B" is small. Consequently, at a point before and after the distance "L" becomes the maximum value Lmax on the cam profile reference line $O_C$-$O_R$ (at the negative direction side of the y-axis on the $O_C$-$O_R$ straight line) by the rotation of the rotor 3, the volume of the pump chamber "B" changes from the increase to the decrease. On the other hand, at a point before and after the distance "L" becomes the minimum value Lmin on the cam profile reference line $O_C$-$O_R$ (at the positive direction side of the y-axis on the $O_C$-$O_R$ straight line), the volume of the pump chamber "B" changes from the decrease to the increase.

Since the rotor 3 rotates in the counterclockwise direction, when a vane 32*a* of the eleven vanes 32 crosses the cam profile reference line $O_C$-$O_R$ at the negative direction side of the y-axis, a volume of a pump chamber Ba at the positive direction side of the z-axis from the cam profile reference line $O_C$-$O_R$ increases. However, when the vane 32 is positioned exactly on the cam profile reference line $O_C$-$O_R$, the volume change becomes zero. And when the vane 32 is positioned on the negative direction side of the z-axis after crossing the cam profile reference line $O_C$-$O_R$, the volume changes to the decrease.

That is, each time the vane 32*a* crosses the cam profile reference line $O_C$-$O_R$ at the negative direction side of the y-axis, the volume of the pump chamber Ba changes from the increase to the decrease. Likewise, each time the vane 32*a* crosses the cam profile reference line $O_C$-$O_R$ at the positive direction side of the y-axis, the volume of the pump chamber Ba changes from the decrease to the increase. With this, each time the vane 32 crosses the cam profile reference line $O_C$-$O_R$, positive and negative of the volume change of the pump chamber "B" are switched.

[Port Reference Line]

Suction and discharge in the pump chamber "B" change between the inlet ports 62, 121 and the outlet ports 63, 122. Positions of the vane 32 at suction/discharge change point are first and second reference positions M1, M2. The first reference position M1 is positioned at the negative direction side of the y-axis, while the second reference position M2 is positioned at the positive direction side of the y-axis.

In the embodiment 1, a space between the adjacent vanes 32 is 1 pitch, and a position of the first reference position M1 is a half-pitch-advanced position from end edges 62*a*, 121*a* (edge portions of rotation direction of the rotor 3) of the inlet ports 62, 121. Likewise, a position of the second reference position M2 is a half-pitch-advanced position from end edges 63*a*, 122*a* (edge portions of a reverse rotation direction of the rotor 3) of the outlet ports 63, 122.

An M1-M2 line formed by these M1 and M2 is defined as a port reference line M1-M2. Thus in the embodiment 1, each time the vane 32*a* passes through this port reference line M1-M2, the suction and discharge of the pump chamber Ba are switched.

A Z-axis positive direction side section Bz+, which is located on the positive direction side of the z-axis (the inlet port 62, 121 side) as compared with the port reference line M1-M2, is a suction section. A Z-axis negative direction side section Bz−, which is located on the negative direction side of the z-axis (the outlet port 63, 122 side) as compared with the port reference line M1-M2, is a discharge section.

The vane 32 rotates from the end edges 62*a*, 121*a* of the inlet ports 62, 121 to start edges 63*b*, 122*b* of the outlet ports 63, 122, thereby pushing or forcing the working fluid on the suction side to the discharge side. A volume of this pushing by the one vane 32 is expressed by the following expression 1.

$$V_{IN} = \sum_{\theta=0}^{\theta=\theta_1} V_{IN}(\theta) \qquad \text{[expression 1]}$$

The vane 32 rotates further from the end edges 63*a*, 122*a* of the outlet ports to start edges 62*b*, 121*b* of the inlet ports, thereby returning the working fluid on the discharge side to the suction side. A volume of this returning by the one vane 32 is expressed by the following expression 2.

$$V_R = \sum_{\theta=0}^{\theta=\theta_1} V_R(\theta) \qquad \text{[expression 2]}$$

When a pump discharge amount (volume) Vout per vane 32 is expressed by the following expression 3, $$V_{out} = \sum_{\theta=0}^{\theta=\theta_1} V_{out}(\theta) \qquad \text{[expression 3]}$$

a total discharge amount (quantity) Qout is provided by the following expression 4.

$$Q_{out} = N \cdot \sum_{\theta=0}^{\theta=\theta_1} V_{out}(\theta) = N \cdot \left( \sum_{\theta=0}^{\theta=\theta_1} V_{IN}(\theta) - \sum_{\theta=0}^{\theta=\theta_1} V_R(\theta) \right) \quad \text{[expression 4]}$$

A pulsation ΔVout that concerns noise of the pump P at this time is a difference between a maximum value and a minimum value of Vout(θ). In brief, this is a fluctuation amount of the pushing volume Vin(θ) (a difference between a maximum value and a minimum value of Vin (θ)) and a fluctuation amount of the returning volume $V_R$ (θ) (a difference between a maximum value and a minimum value of $V_R$ (θ)). For reduction of the pulsation, these fluctuation amounts are required to be small.

Figure 5:
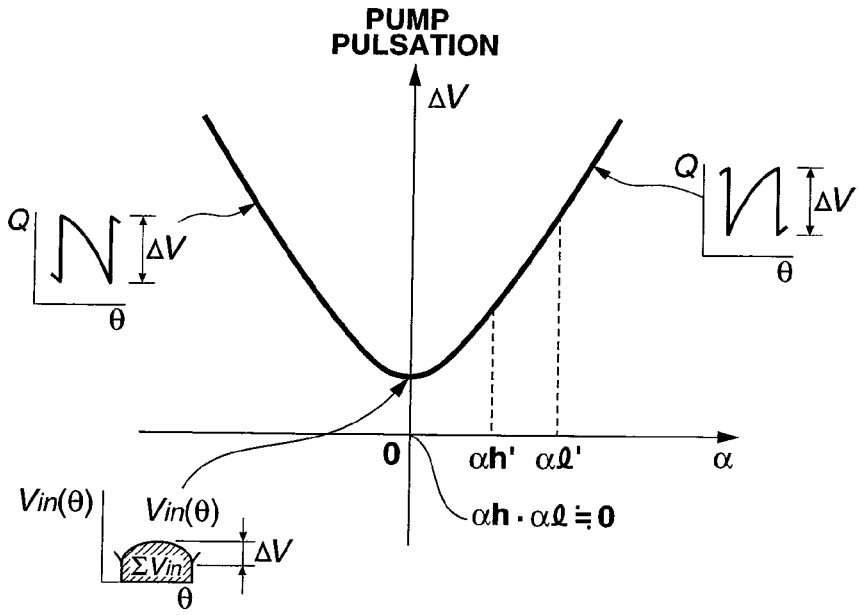
FIG. 5 is a drawing that shows a relationship between an angle between a port reference line M1-M2 and a cam profile reference line $O_C$-$O_R$ and pump pulsation.

When the port reference line M1-M2 and the cam profile reference line $O_C$-$O_R$ become equal to each other, the volume of the pump chamber "B" by the vane 32 changes from the increase to the decrease at the negative direction side of the y-axis, and the fluctuation amounts of the pushing volume Vin (θ) and the returning volume $V_R$ (θ) become small (see FIG. 5).

When the cam profile reference line $O_C$-$O_R$ deviates with respect to the port reference line M1-M2 in a right upper direction, a proportion of the decrease in the volume of the pump chamber "B" rises at the negative direction side of the y-axis, and the fluctuation amount increases (FIG. 5). Conversely, when the camprofile reference line $O_C$-$O_R$ deviates with respect to the port reference line M1-M2 in a left lower direction, a proportion of the increase rises, and the fluctuation amount increases (FIG. 5).

Hence, in order to stabilize the discharge of the vane pump 1, it is desirable that the cam profile reference line $O_C$-$O_R$ on which the positive/negative of the volume change of the pump chamber "B" are switched and the port reference line M1-M2 on which the suction/discharge of the pump chamber B are switched should be as close as possible to each other.

In particular, if the both lines are close to each other at the first reference position M1 that is the switch position from the suction to the discharge and at the second reference position M2 that is the switch position from discharge to the suction, a discharge amount fluctuation is stable. Thus, it is desirable that the cam profile reference line $O_C$-$O_R$ and the port reference line M1-M2 should be as close as possible to each other and also as parallel as possible to each other.

[Relationship Between Port Reference Line and Cam Profile Reference Line $O_C$-$O_R$]

FIG. 5 is a drawing that shows a relationship between an angle α between the port reference line M1-M2 and the cam profile reference line $O_C$-$O_R$ and a discharge flow amount pulsation that causes a pump pulsation. An angle at high pressure is denoted by αh. An angle at low pressure is denoted by αl. αh' and αl' are angles of the conventional art.

Figure 6:
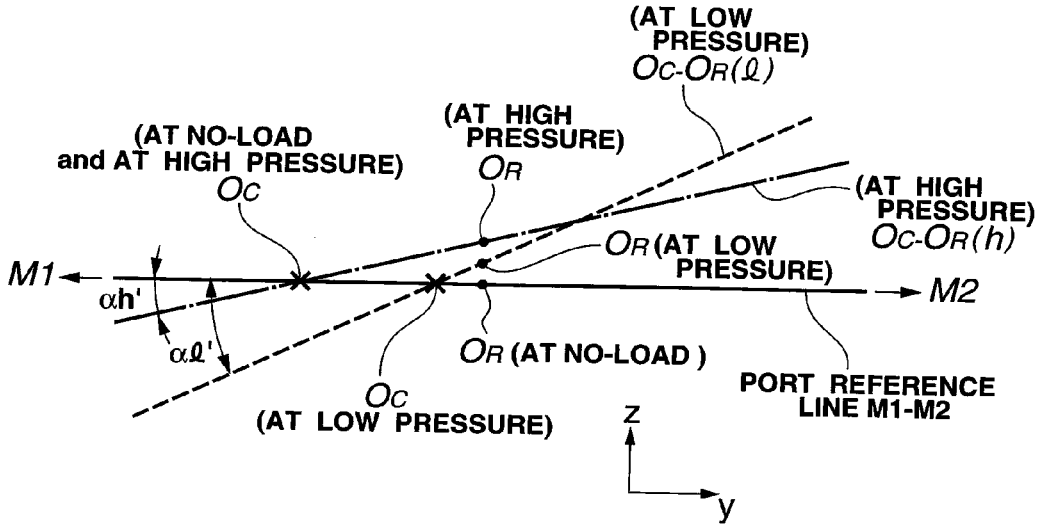
FIG.6 CONVENTIONAL ART
FIG. 6 is a schematic diagram showing a relationship between the port reference line M1-M2 and the cam profile reference line $O_C$-$O_R$, of a conventional art.
Figure 7:
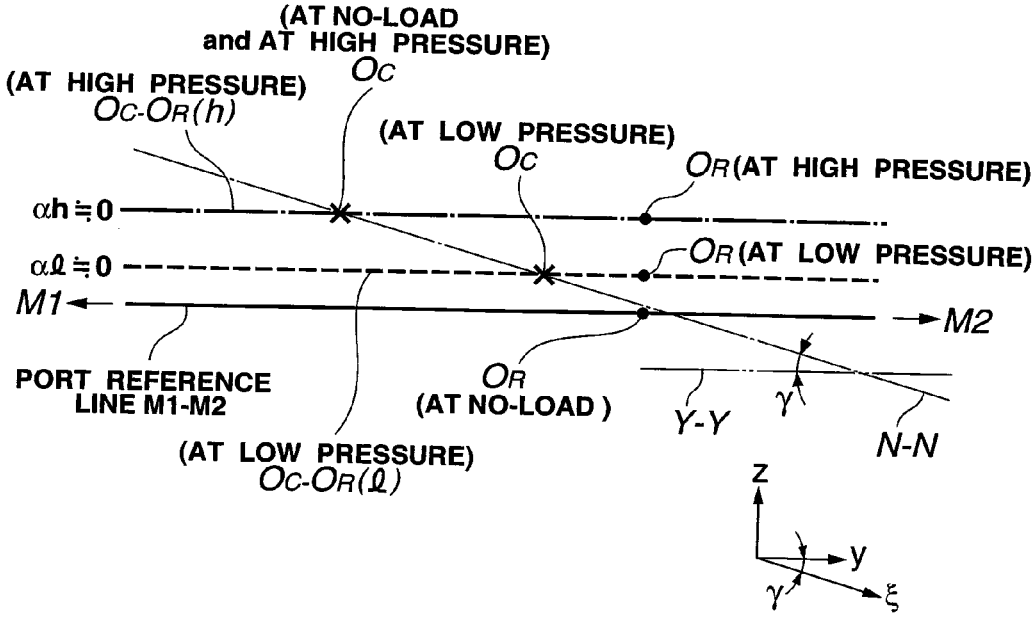
FIG. 7 is a schematic diagram showing a relationship between the port reference line M1-M2 and the cam profile reference line $O_C$-$O_R$, of the embodiment 1 of the present invention.

FIGS. 6 and 7 are schematic diagrams showing a relationship between the port reference line M1-M2 and the cam profile reference line $O_C$-$O_R$. FIG. 6 is the conventional art (a case where the center $O_C$ of the cam ring 4 and the center $O_R$ of the driving shaft 2 are positioned on the port reference line M1-M2 in the no-load state (in the no-pump-drive state) is shown). FIG. 7 is the embodiment 1 (a case where the cam ring center $O_C$ is positioned at the positive direction side of the z-axis as compared with the port reference line M1-M2 in the no-load state is shown).

Here, in FIGS. 6 and 7, a thick solid line is the port reference line M1-M2, a thick alternate long and short dash line is the cam profile reference line $O_C$-$O_R$ (h) under a pump high pressure condition, and a thick broken line is the cam profile reference line $O_C$-$O_R$ (l) under a pump low pressure condition.

In addition, a thin alternate long and short dash line N-N is a straight line that is parallel to the supporting surface "N" of the cam ring 4, i.e. a rocking locus of the cam ring center $O_C$. A thin alternate long and two short dashes line Y-Y is a straight line that is parallel to the y-axis. Therefore, the cam ring 4 rocks along the N-N straight line. And as same as the supporting surface "N", the N-N straight line is parallel to the ξ-axis, and its angle with respect to the Y-Y straight line becomes γ.

The cam ring center $O_C$ shifts in the y-axis direction by the rock of the cam ring 4. Then at the no-load and at the maximum eccentricity at which the pressure is the high pressure (see FIG. 2), the cam ring center $O_C$ is widely offset from the driving shaft center $O_R$ in the negative direction of the y-axis. On the other hand, at the low pressure, the eccentricity amount of the cam ring 4 is small and an offset amount of the cam ring center $O_C$ is also small. However, the cam ring center $O_C$ is still offset from the driving shaft center $O_R$.

Here, when the pump 1 is driven and the pressure is produced in the pump chamber "B", the Z-axis negative direction side section Bz− becomes the high pressure, while the Z-axis positive direction side section Bz+becomes the low pressure, with the port reference line M1-M2 being a boundary in the pump chamber "B", and the pressure difference therefore occurs.

By this pressure difference, the rotor 3 is forced in the positive direction of the z-axis together with the driving shaft 2, and the driving shaft 2 is elastically bent in the positive direction of the z-axis. The center $O_R$ of the driving shaft 2 also shifts to the positive direction side of the z-axis due to this elastic deformation, then the deviation between the cam ring center $O_C$ and the driving shaft center $O_R$ appears. A deviation amount becomes great at the high pressure, while it becomes small at the low pressure.

As a consequence, in the conventional art (FIG. 6), due to the elastic deformation of the driving shaft 2 by the outlet pressure "Pout", each of the cam profile reference lines $O_C$-$O_R$ at the high pressure and at the low pressure widely slopes with respect to the port reference line M1-M2. Angles of the cam profile reference lines $O_C$-$O_R$ at the high pressure and at the low pressure with respect to the port reference line M1-M2, are αh', αl'.

αh' and αl' are both large (αh'>0, αl'>0), and thus the cam profile reference line $O_C$-$O_R$ and the port reference line M1-M2 are positioned away from each other at the first and second reference positions M1, M2 at which the suction/discharge are switched, and this results in an unstable discharge and the pulsation becomes great (FIG. 5).

On the other hand, in the embodiment 1 of the present invention, the cam ring center $O_C$ is previously offset to the positive direction side of the z-axis (the inlet port 62, 121 side) from the driving shaft center $O_R$, and the cam profile reference lines $O_C$-$O_R$ (h), $O_C$-$O_R$ (l) and the port reference line M1-M2 are set so as to be substantially parallel to each other at both the high pressure and the low pressure.

With this setting, the cam ring center $O_C$ is previously positioned close to the port reference line M1-M2, and the positions in the z-axis direction of the cam ring center $O_C$ and the driving shaft center $O_R$ are not widely separated from each other. Hence, the angle α between the cam profile reference line $O_C$-$O_R$ and the port reference line M1-M2 during the pump drive becomes approximately zero at both the high pressure and the low pressure, and the discharge amount fluctuation upon the switch of the suction/discharge becomes small.

That is to say, in the embodiment 1 of the present invention, since the supporting surface "N" supporting the cam ring 4 is provided so that the supporting surface "N" gradually separates from the port reference line M1-M2 in a direction from the first hydraulic pressure chamber A1 to the second hydraulic pressure chamber A2 (towards the positive direction side of the y-axis), the driving shaft 2 is bent and shifted to the inlet port 62, 121 side (the positive direction side of the z-axis) as compared with the cam ring center $O_C$ at the maximum eccentricity and high pressure.

Thus, in order for the cam profile reference line $O_C$-$O_R$ to be able to be substantially parallel to the port reference line M1-M2, by raising a position of the rolling-fulcrum "Na" of the cam ring 4 to the positive direction side of the z-axis, its position is shifted by an amount equivalent to the bend of the driving shaft center $O_R$. At a small eccentricity and low pressure, the bend of the driving shaft 2 is small, thus this shift amount of the rolling-fulcrum "Na" could be small.

With this, even when the driving shaft center $O_R$ shifts in the positive direction of the z-axis, the three reference lines; the port reference line M1-M2 on which the suction/discharge are switched and the cam profile reference lines $O_C$-$O_R$ (h), $O_C$-$O_R$ (l) at the high pressure and at the low pressure on which the positive/negative of the volume change of the pump chamber "B" are switched, are substantially parallel to each other, then the pump discharge amount fluctuation is reduced at both the high pressure and the low pressure.

Here, although pressure noise generally increases in proportion to the pressure, since the cam profile reference line $O_C$-$O_R$ (h) at the high pressure is the line that connects a cam ring center $O_C$ (h) when the outlet pressure "Pout" is a maximum and the driving shaft center $O_R$, it is possible that the pump pulsation at the maximum pressure is reduced. With this, pulsation noise when the pump outlet pressure "Pout" is the maximum is reduced, and the pump pulsation as a whole is reduced.

Figure 10:
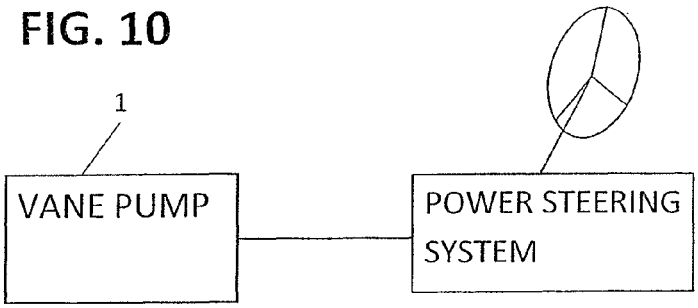
FIG. 10 is a schematic representation of a vane pump according to the invention applied as a hydraulic pressure source of the power steering system.
Figure 11:
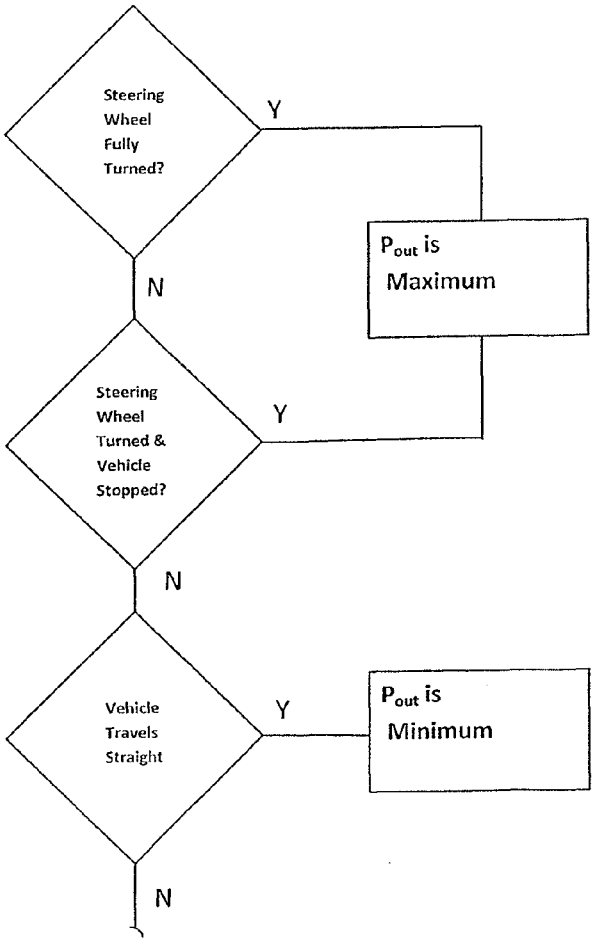
FIG. 11 is an illustration of certain circumstances in which a vane pump outlet pressure is a maximum or minimim.

Furthermore, as schematically represented in FIG. 10, the vane pump 1 of the present invention is a hydraulic pressure source of a power steering system, and, as schematically represented in FIG. 11, the high pressure condition (the outlet pressure "Pout" maximum condition) occurs when a steering wheel is fully turned or is turned in a vehicle stop state, and also the low pressure condition (an outlet pressure "Pout" minimum condition) occurs when the vehicle travels straight ahead. Therefore, since the pump pulsation is reduced at both the high pressure and the low pressure, also in each of the cases where the steering wheel is fully turned or is turned in the vehicle stop state and the vehicle travels straight ahead, the pump pulsation is reduced.

[Effect of the Embodiment 1]

A variable capacity vane pump comprises: the pump body 10; the driving shaft 2 rotatably supported by the pump body 10; the rotor 3 provided in the pump body 10 and rotatably driven by the driving shaft 2; a plurality of vanes 32 radially extendably installed in their respective slots 31 that are arranged in the circumferential direction in the rotor 3; the cam ring 4 rockably provided on the supporting surface "N" with the pin 40 of the rock fulcrum being the center in the pump body 10 and formed into the ring shape also forming a plurality of pump chambers B at the inner circumference 41 side of the cam ring 4 in cooperation with the rotor 3 and the vanes 32; the side plate 6 and the second housing 12 provided at both sides in the x-axis direction of the cam ring 4; the inlet port 62; 121 provided at least one of the side plate 6 and the second housing 12 and opening to the section of the pump chamber where the volume of the pump chamber increases; the outlet port 63; 122 provided at least one of the side plate 6 and the second housing 12 and opening to a section of the pump chamber where the volume of the pump chamber decreases; and the seal member 50 provided at an outer circumference side of the cam ring 4 and defining the first hydraulic pressure chamber A1 located at the side where the pump discharge amount increases and the second hydraulic pressure chamber A2 located at the side where the pump discharge amount decreases in the space (the hydraulic pressure chamber A) outside the outer circumference of the cam ring 4, and the space between adjacent vanes 32 of the plurality of vanes 32 is 1 pitch, the line that connects the half-pitch-advanced position M1 from the end edge 62*a*, 121*a* of the inlet port 62; 121 and the half-pitch-advanced position M2 from the end edge 63*a*, 122*a* of the outlet port 63; 122 is termed the port reference line M1-M2, the line that connects the center $O_C$ of the cam ring inner circumference 41 side and the center $O_R$ of the driving shaft 2 at the high pressure when the eccentricity amount of the cam ring 4 is the maximum is termed the high pressure cam profile reference line $O_C$-$O_R$, the line that connects the center $O_C$ of the cam ring inner circumference 41 side and the center $O_R$ of the driving shaft 2 at the low pressure when the eccentricity amount of the cam ring 4 is the minimum is termed the low pressure cam profile reference line $O_C$-$O_R$, and the three reference lines; the port reference line M1-M2, the high pressure cam profile reference line $O_C$-$O_R$ and the low pressure cam profile reference line $O_C$-$O_R$, are set to be substantially parallel to each other.

With this, by setting the cam profile reference line $O_C$-$O_R$ and the port reference line M1-M2 during the pump drive to be substantially parallel to each other, it is possible that the discharge amount fluctuation upon the switch of the suction/discharge becomes small. Accordingly, the discharge can be stabilized at both the high pressure and the low pressure, and the decrease in the pump efficiency and the oscillation can be suppressed.

In the following, a modification example of the embodiment 1 will be described.

[Embodiment 1-1]

Figure 8:
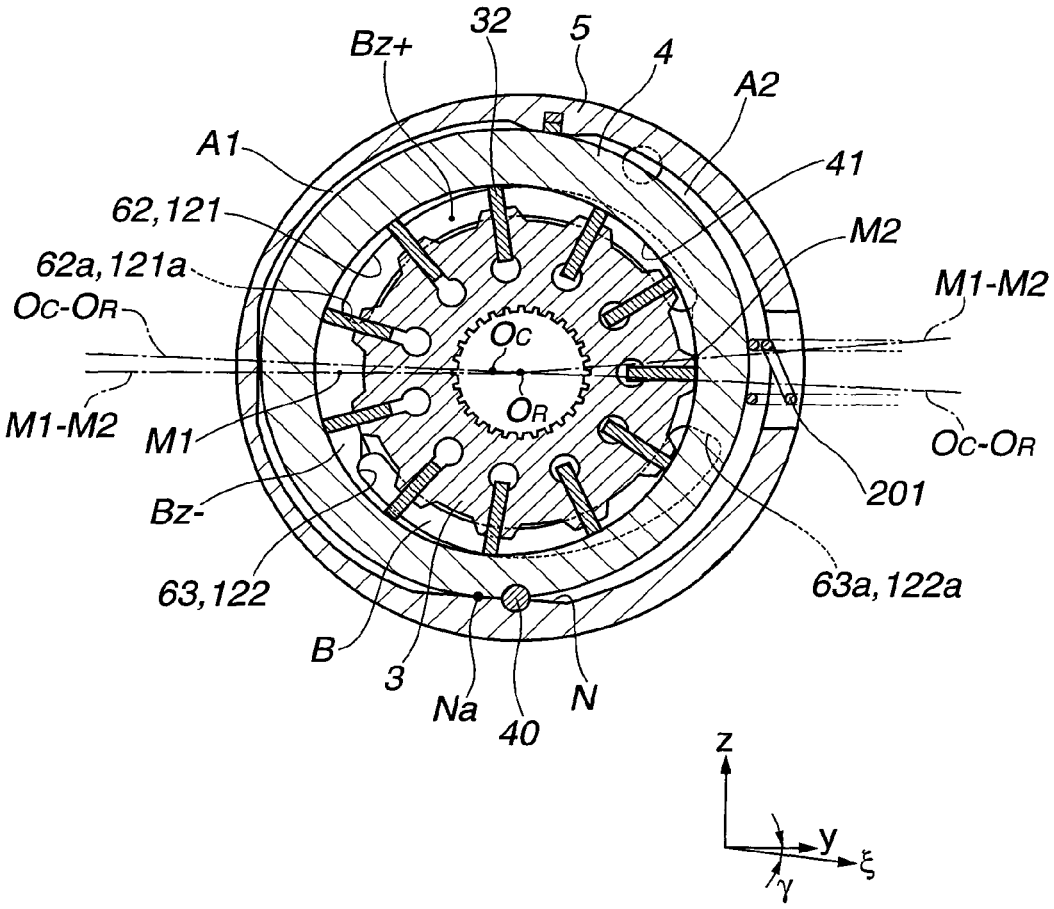
FIG. 8 is a sectional view of the part of the vane pump according to an embodiment 1-1.

FIG. 8 is an example in which the definition of the port reference line is changed. In the embodiment 1, the first and second reference positions M1, M2 at which the suction/discharge are switched and the driving shaft center $O_R$ are positioned on the one straight line. However, in the embodiment 1-1, a case where these are not positioned on the one straight line is shown.

Straight lines that connect the first reference position M1, the second reference position M2 and the driving shaft center $O_R$ in the no-load state respectively, are a port reference line M1-$O_R$ and a port reference line M2-$O_R$. When the eccentricity amount of the cam ring 4 is the maximum, a straight line that connects the center $O_C$ of the cam ring inner circumference side 41 and the driving shaft center $O_R$ is a high pressure cam profile reference line $O_C$-$O_R$. When the eccentricity amount of the cam ring 4 is the minimum, a straight line that connects the center $O_C$ of the cam ring inner circumference side 41 and the driving shaft center $O_R$ at the low pressure is a low pressure cam profile reference line $O_C$-$O_R$. Then, the three reference lines; the port reference line M1-$O_R$ or the port reference line M2-$O_R$, the high pressure cam profile reference line $O_C$-$O_R$ and the low pressure cam profile reference line $O_C$-$O_R$, are set to be substantially parallel to each other.

With this setting, the same working and effects as the embodiment 1 can be obtained. In the embodiment 1-1, since an M1-$O_R$-M2 line is a bent line, the M1-$O_R$ line or the M2-$O_R$ line is the port reference line. By properly changing the definition of the port reference line according to the characteristic of the vane pump 1, an optimum discharge performance can be gained. Here, the M1-$O_R$-M2 line of the bent line could be the port reference line as it is.

[Embodiment 2]

Embodiment 2 will be explained on the basis of FIG. 9. The basic structure of the embodiment 2 is the same as the embodiment 1, thus only different points will be explained. In the embodiment 1, the cam ring 4 is forced in the negative direction of the y-axis by the spring 201.

In contrast to this, in the embodiment 2, instead of the plug member 70, a piston 200 is provided as the plug member. Then, a space defined by an inner circumference of this piston 200 and a lid member 202 is a third hydraulic pressure chamber A3, and the third hydraulic pressure chamber A3 communicates with the control valve 7. With this, a pressure P3 of the third hydraulic pressure chamber A3 is controlled. This point is different from the embodiment 1.

Figure 9:
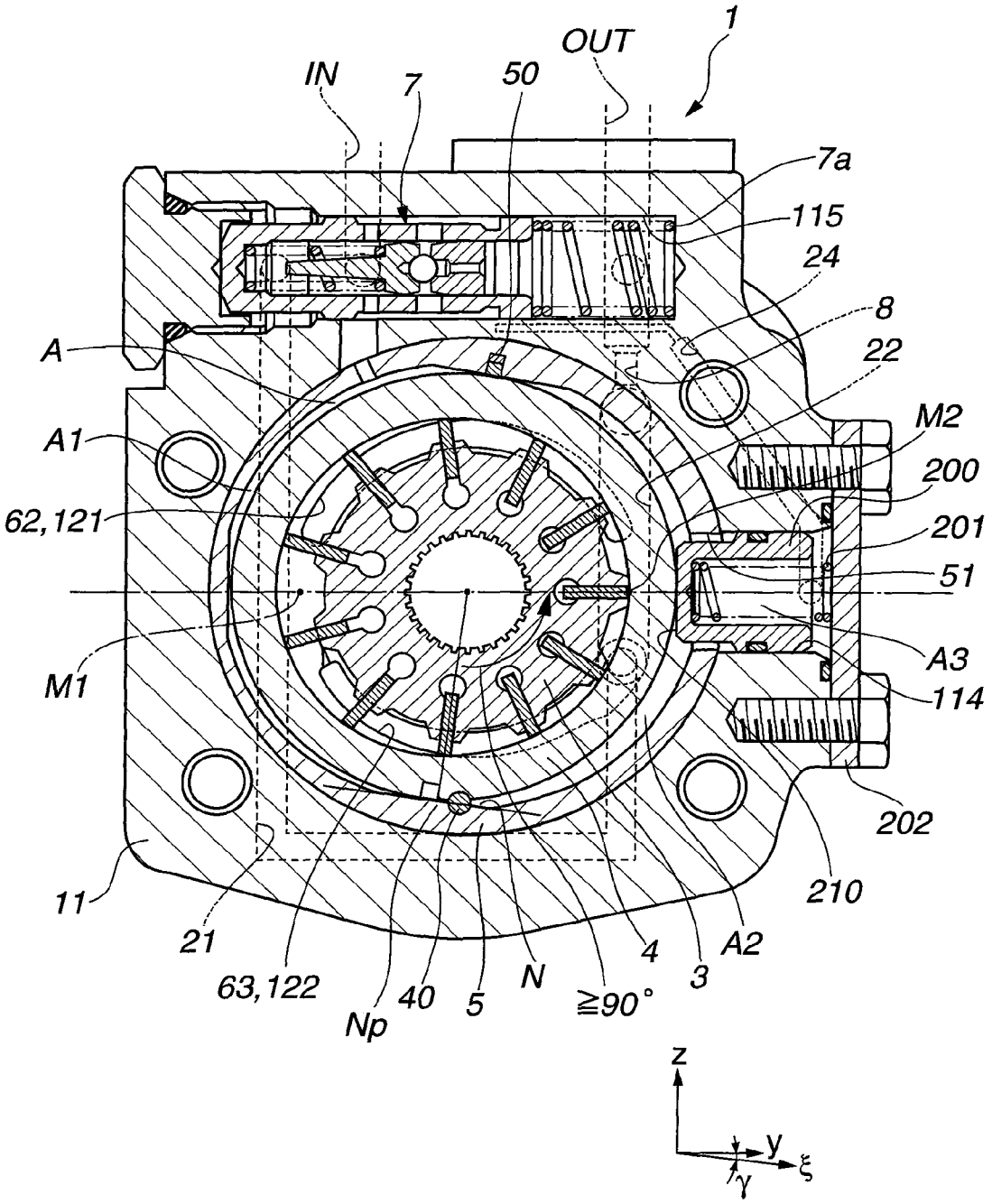
FIG. 9 is a sectional view of the part of the vane pump according to an embodiment 2.

FIG. 9 is a sectional view in a radial direction of the vane pump 1 according to the embodiment 2. The cup-shaped piston 200 having a bottom is inserted into a piston insertion hole 114 of the first housing 11 and the radial-direction penetration hole 51 of the adapter ring 5 with a bottom portion 210 facing toward the negative direction side of the y-axis. Upon the insertion, the piston 200 is slidably fitted into the piston insertion hole 114 in the y-axis direction with an outer circumference of the piston 200 and the piston insertion hole 114 kept in liquid-tight contact.

The piston insertion hole 114 is closed by the lid member 202 and liquid-tightly insulated from the outside of the pump, then the third hydraulic pressure chamber A3 is defined by the inner circumference of the piston 200 and the lid member 202. The third hydraulic pressure chamber A3 is located at an outer circumference side of the outlet ports 63, 122.

The spring 201 is inserted into the piston 200 and is secured in an inner circumference of the piston 200 so that the spring 201 is extendable and contractible in the y-axis direction. One end of the spring 201 is secured to the lid member 202 at the positive direction side of the y-axis, and the spring 201 forces the piston 200 in the negative direction of the y-axis.

With this, the bottom portion 210 of the piston 200 penetrates the radial-direction penetration hole 51 of the adapter ring 5 and touches the cam ring 4, then forces the cam ring 4 in the negative direction of the y-axis through the second hydraulic pressure chamber A2.

Further, in the embodiment 2, a communication passage 24 that connects the third hydraulic pressure chamber A3 and the control valve 7 is provided inside the first housing 11. The communication passage 24 opens to the valve installation hole 115 that installs the control valve 7 therein, and the control pressure "Pv" is introduced into the third hydraulic pressure chamber A3 with the pumping action.

In the same manner as the embodiment 1, the control valve 7 connects to the outlet ports 63, 122 through the oil passages 21 and 22. The orifice 8 is provided on the oil passage 22, and the outlet pressure "Pout" that is the upstream pressure of the orifice 8 and the downstream pressure "Pfb" of the orifice 8 are introduced into the control valve 7. Then, the control valve 7 is driven by the pressure difference between these "Pout" and "Pfb" and the valve spring 7*a*, and the control pressure "Pv" is produced.

Although the rocking action or working of the cam ring 4 is the same as the embodiment 1, the supporting surface "N" supporting the cam ring 4 slopes in the negative direction of the z-axis as the supporting surface "N" extends in the positive direction of the y-axis with respect to the port reference line (M1-$O_R$, M2-$O_R$ or M1-M2). For this reason, when the pump P is driven, the pressure acts on the negative direction side of the Z-axis of the cam ring 4 in the negative direction of the Z-axis of the port reference line, and a resultant force of the pressure acts in the positive direction of the y-axis with respect to the rock fulcrum of the cam ring 4.

If an elastic force of the spring 201 against this resultant force is small, self-eccentricity of the cam ring 4 occurs. Therefore, the control pressure "Pv" is introduced into the third hydraulic pressure chamber A3, and thereby preventing the tilt of the cam ring 4 to the second hydraulic pressure chamber A2 side (to the positive direction side of the y-axis).

With this, the three port reference lines (M1-$O_R$, M2-$O_R$ and M1-M2) become substantially parallel to each other, then the pump pulsation is reduced. Moreover, it becomes possible to force the cam ring 4 in a direction of the maximum eccentricity (in the negative direction of the y-axis) through the pressure. Thus even when a large discharge amount is required, the cam ring 4 can be shifted to the maximum eccentricity side instantly or quickly, and a desired pressure can be immediately obtained. For example, even when the steering wheel is turned abruptly in the hydraulic power steering system, this can prevent a problem such as unsmooth steering.

Although the invention has been described above by reference to certain embodiment of the invention, the invention is not limited to the embodiment described above. Further, design changes or engineering-change based on the embodiment are also included in the invention.

In the embodiment 2, although the control pressure "Pv" is introduced into the third hydraulic pressure chamber A3, the outlet pressure "Pout" could be directly introduced into the third hydraulic pressure chamber A3.

The invention claimed is:

1. A variable capacity vane pump comprising:

a pump body;

a driving shaft rotatably supported by the pump body;

a rotor provided in the pump body and rotatably driven by the driving shaft;

a plurality of vanes radially extendably installed in their respective slots that are arranged in a circumferential direction in the rotor;

a cam ring rockably provided on a supporting surface with a rock fulcrum being a center in the pump body and formed into a ring shape also forming a plurality of pump chambers at an inner circumference side of the cam ring in cooperation with the rotor and the vanes;

first and second members provided at both sides in an axial direction of the cam ring;

an inlet port provided at at least one of the first and second members and opening to a section of the pump chamber where a volume of the pump chamber increases;

an outlet port provided at at least one of the first and second members and opening to a section of the pump chamber where the volume of the pump chamber decreases; and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring, a space between adjacent vanes of the plurality of vanes being 1 pitch, wherein a port reference line connects a half-pitch-advanced position from an end edge of the inlet port or from an end edge of the outlet port and a center of the driving shaft in a no-load state, a high pressure cam profile reference line connects a center of the cam ring inner circumference side and the center of the driving shaft at a high pressure when an eccentricity amount of the cam ring is a maximum, and a low pressure cam profile reference line connects the center of the cam ring inner circumference side and the center of the driving shaft at a low pressure when the eccentricity amount of the cam ring is a minimum, and the supporting surface supporting the cam ring in the pump body is provided so as to gradually separate from the port reference line in a direction from the first hydraulic pressure chamber to the second hydraulic pressure chamber so that the port reference line, the high pressure cam profile reference line and the low pressure cam profile reference line are set to be substantially parallel to each other.

2. The variable capacity vane pump as claimed in claim 1, further comprising:

a pressure chamber that is provided on the second hydraulic pressure chamber side and forces the cam ring in a direction of a maximum eccentricity.

3. The variable capacity vane pump as claimed in claim 1, wherein:

the high pressure cam profile reference line is a line that connects the cam ring center when an outlet pressure "Pout" is a maximum and the driving shaft center.

4. The variable capacity vane pump as claimed in claim 3, wherein:

the variable capacity vane pump is applied as a hydraulic pressure source of a power steering system, and when a steering wheel of the power steering system is fully turned, the outlet pressure "Pout" is set to be maximum.

5. The variable capacity vane pump as claimed in claim 3, wherein:

the variable capacity vane pump is applied as a hydraulic pressure source of a power steering system, and when a steering wheel of the power steering system is turned in a vehicle stop state, the outlet pressure "Pout" is set to be maximum.

6. The variable capacity vane pump as claimed in claim 1, wherein:

the variable capacity vane pump is applied as a hydraulic pressure source of a power steering system, and when a vehicle travels straight ahead, an outlet pressure "Pout" is set to be minimum.

7. A variable capacity vane pump comprising:

a pump body;

a driving shaft rotatably supported by the pump body;

a rotor provided in the pump body and rotatably driven by the driving shaft;

a plurality of vanes radially extendably installed in their respective slots that are arranged in a circumferential direction in the rotor;

a cam ring rockably provided on a supporting surface with a rock fulcrum being a center in the pump body and formed into a ring shape also forming a plurality of pump chambers at an inner circumference side of the cam ring in cooperation with the rotor and the vanes;

first and second members provided at both sides in an axial direction of the cam ring;

an inlet port provided at at least one of the first and second members and opening to a section of the pump chamber where a volume of the pump chamber increases;

an outlet port provided at at least one of the first and second members and opening to a section of the pump chamber where the volume of the pump chamber decreases; and a seal member provided at an outer circumference side of the cam ring and defining a first hydraulic pressure chamber located at a side where a pump discharge amount increases and a second hydraulic pressure chamber located at a side where the pump discharge amount decreases in a space outside the outer circumference of the cam ring, a space between adjacent vanes of the plurality of vanes being 1 pitch, wherein a port reference line connects a half-pitch-advanced position from an end edge of the inlet port and a half-pitch-advanced position from an end edge of the outlet port, a high pressure cam profile reference line connects a center of the cam ring inner circumference side and the center of the driving shaft at a high pressure when an eccentricity amount of the cam ring is a maximum, a low pressure cam profile reference line connects the center of the cam ring inner circumference side and the center of the driving shaft at a low pressure when the eccentricity amount of the cam ring is a minimum, and the supporting surface supporting the cam ring in the pump body is provided so as to gradually separate from the port reference line in a direction from the first hydraulic pressure chamber to the second hydraulic pressure chamber so that the port reference line the high pressure cam profile reference line and the low pressure cam profile reference line are set to be substantially parallel to each other.

8. The variable capacity vane pump as claimed in claim 7, further comprising:

a pressure chamber that is provided on the second hydraulic pressure chamber side and forces the cam ring in a direction of a maximum eccentricity.

9. The variable capacity vane pump as claimed in claim 7, wherein:

the high pressure cam profile reference line is a line that connects the cam ring center when an outlet pressure "Pout" is a maximum and the driving shaft center.

10. The variable capacity vane pump as claimed in claim 9, wherein:

the variable capacity vane pump is applied as a hydraulic pressure source of a power steering system, and when a steering wheel of the power steering system is fully turned, the outlet pressure "Pout" is set to be maximum.

11. The variable capacity vane pump as claimed in claim 9, wherein:

the variable capacity vane pump is applied as a hydraulic pressure source of a power steering system, and when a steering wheel of the power steering system is turned in a vehicle stop state, the outlet pressure "Pout" is set to be maximum.

12. The variable capacity vane pump as claimed in claim 7, wherein:

the variable capacity vane pump is applied as a hydraulic pressure source of a power steering system, and when a vehicle travels straight ahead, an outlet pressure "Pout" is set to be minimum.

* * * * *